US008424468B2

(12) United States Patent
Aden et al.

(10) Patent No.: US 8,424,468 B2
(45) Date of Patent: Apr. 23, 2013

(54) ALTERNATIVE PALLET RAIL, PALLET ASSEMBLY, AND METHOD FOR MAKING SAME

(76) Inventors: Alan A Aden, Longwood, FL (US); Russell Ortner, Apopka, FL (US)

( * ) Notice: Subject to any disclaimer, the term of this patent is extended or adjusted under 35 U.S.C. 154(b) by 93 days.

(21) Appl. No.: 12/829,308

(22) Filed: Jul. 1, 2010

(65) Prior Publication Data

US 2012/0000399 A1 Jan. 5, 2012

(51) Int. Cl.
*B65D 19/12* (2006.01)

(52) U.S. Cl.
USPC ..... 108/56.3; 108/57.32

(58) Field of Classification Search ..... 108/56.1, 108/56.3, 57.1, 57.17–57.19, 57.32
See application file for complete search history.

(56) References Cited

U.S. PATENT DOCUMENTS

| | | | | |
|---|---|---|---|---|
| 5,071,280 | A * | 12/1991 | Turner | 403/232.1 |
| 5,076,175 | A * | 12/1991 | Whatley, II | 108/51.11 |
| 5,329,861 | A | 7/1994 | McCarthy | |
| 5,359,861 | A | 11/1994 | Maier-Laxhuber et al. | |
| 5,595,125 | A | 1/1997 | Bridges, Jr. | |
| 5,660,118 | A | 8/1997 | Adams, Jr. | |
| 5,784,971 | A | 7/1998 | Chang | |
| 5,934,202 | A | 8/1999 | Lai | |
| 6,357,364 | B1 | 3/2002 | Maloney et al. | |
| 6,584,915 | B1 * | 7/2003 | Rogers | 108/56.1 |
| 6,612,207 | B2 | 9/2003 | Schiffers | |
| 6,766,749 | B2 * | 7/2004 | Lacabanne | 108/56.3 |
| 2006/0196394 | A1 * | 9/2006 | Bailey | 108/56.1 |

* cited by examiner

*Primary Examiner* — Hanh V Tran
(74) *Attorney, Agent, or Firm* — Michael L Leetzow, P.A.

(57) ABSTRACT

A new pallet rail that is light weight, strong and environmentally friendly is part of an alternative modular pallet assembly. The rail includes a recessed portion with projections extending thereinto. A method of making the pallet rails and assembly is also disclosed.

16 Claims, 6 Drawing Sheets

FIGURE 4

ALTERNATIVE PALLET RAIL, PALLET ASSEMBLY, AND METHOD FOR MAKING SAME

BACKGROUND OF THE INVENTION

1. Field of the Invention

The present invention relates generally to a pallet rail for a shipping pallet, a shipping pallet, and, in particular, a pallet rail that is light weight, has a recessed portion with projections extending in the recessed portion and a shipping pallet using the pallet rail.

2. Technical Background

Traditionally, pallets have been made of wood planks nailed together. In one common structure, a series of parallel upper wood planks are nailed to the top of three transversely extending, parallel, and equally-spaced wood support planks. Similarly, a series of parallel lower wood planks are nailed to the bottom of the three support planks. The tines of forklifts and/or pallet jacks can slide under the upper planks in the two parallel channels formed by the three spaced support planks. The forklift or pallet jack can then raise its tines, which lifts the pallet and anything mounted on it. While such pallets have been used for decades, they suffer from a surprising number of deficiencies.

One is that the wood pallets require treating the wood. These requirements for the treatment of wood pallets have made the use of such wood pallets disadvantageous for many reasons, including increased cost and manufacturing complexity. However, it should be noted that since plastics and paper/corrugated packaging materials are inherently bugproof, the regulations apply only to international shipments involving wood packaging materials. Upon inspection for export, any wood pallet found not to be in compliance with the rules would be destroyed, forcing goods to be re-palletized onto an approved pallet, or fumigated on site—all at the expense of the shipper.

Another deficiency of wood pallets relates to environmental concerns. One third of US landfills will not take pallets, and others charge fees for taking pallets. Most pallets are eventually abandoned, left to pile up as a dangerous nuisance.

These issues are not of great concern with plastics and paper/corrugated packaging materials, as pallets made of these materials are recyclable. It is worth noting that recyclable, paper-based pallets are already favored for export to environmentally concerned countries, such as the various EU members.

A further deficiency of wood pallets revolves around the effect of their weight on a whole range of issues, such as added transportation costs, and handling difficulties for workers. The average weight of a 48" by 40" block style wood pallet with four way entry is approximately 45 lbs. The shipper must pay for the net weight of the pallet as part of the total transportation cost of the shipment, in all less-than-truckload (so-called "LTL") volumes, as well as all domestic and international shipments by air. This added expense is significant. For example, the average domestic LTL trucking rate is $0.33 per lb. This means that it costs the shipper $14.85 to ship each pallet without any freight on it. With domestic air rates ranging from $0.60-$1.50 per lb. (depending on the service level), and export air rates at $1.00 per lb., the expense of shipping the pallet itself can have a profound impact on the total transportation cost.

The handling of wood pallets by warehouse workers has been an issue for many years in terms of the repetitive lifting of heavy weights and injuries caused by splinters, exposed nails, and falling pallets. The issue of weight has grown as a concern since women are joining the traditionally male workforce in warehouses and shipping docks. OSHA has pressed U.S. industries to minimize human lifting weights to 45 lbs. It is common knowledge that the weight and condition of wood pallets have contributed to workmen's compensation claims in the transportation industry and has become a cost factor regarding their use. Government regulations and company work rules usually require that a damaged wood pallet be taken out of service and either repaired or replaced unless the damage is very minor.

Still a further deficiency of wood pallets is the quality of the top load-bearing surface. Very frequently, the top surface is made of rough and uneven wood, which can cause damage to outer packaging, and sometimes to the goods themselves. While this might seem minor, in normal warehouse conditions where freight is handled roughly and quickly, damage claims can easily result.

For decades, non-wood alternative pallet products, particularly paper-based/corrugated and plastic products, have been manufactured and widely distributed. Examples of such pallets are disclosed in U.S. Pat. Nos. 5,329,861; 5,595,125; 5,660,118; 5,784,971; 5,934,202; 6,357,364; and 6,612,207. These alternative products faced a number of obstacles that limited their ability to gain greater market share against wood pallets. One such obstacle is that generally pallets made from durable, recyclable, and reusable plastics, are regarded as far too expensive for single-use applications, and have only gained market share in closed loop transport systems where they can be recovered. Good plastic pallets generally cost between $75 and $90 each. Another obstacle has been that traditional paper-based pallets made from "homogeneous" materials such as Kraft paper honeycomb and corrugated paperboard have never enjoyed a significant price advantage over new wood pallets or a cost advantage when compared to used/reconditioned wood pallets.

A further obstacle has been that traditional paper-based pallets generally cannot match many performance attributes inherent to wood pallets (especially relating to the deck support aspect of load-bearing). No currently offered paper pallet even claims to be strong enough to be used in unsupported warehouse racking systems. Wood pallets can be placed side by side in a warehouse rack loaded with freight, and stacked one on top of the other to a reasonable height limit. Such is not true of currently known paper-based pallets.

Still a further obstacle facing paper-based pallets is that they have not been able to overcome their greatest perceived weakness; that they cannot be exposed to any water or be used in a wet environment. Consequently, unlike wood pallets, paper pallets cannot be stored outside, which is a common practice in many areas of this country. Although U.S. Pat. No. 5,359,861 does briefly mention that portions of the paper-based pallet could be coated with polyethylene, this process may not be very effective and typically is high in cost.

What is desired, therefore, is a pallet system which is constructed from a wood alternative, which does not present a hazard of facilitating the migration of pests, which is not subject to the treatment requirements imposed by governmental agencies, which is relatively inexpensive to create and use, which does not pose great environmental concerns, which is lower in weight than wood pallets, which has a top surface which is not prone to damaging goods shipped thereon, which has a strength similar to that of wood pallets, and which is water resistant such that it can be used in humid or wet environments.

SUMMARY OF THE INVENTION

Disclosed herein is a pallet rail to be used with a shipping pallet that includes an upper portion extending the length of the rail to support a shipping pallet deck, the upper portion having two upper surfaces and a lower surface, the lower surface connected to the two upper surfaces by upward extending portions, the lower surface and upward extending portions forming a recessed area between the two upper surfaces, the recessed area extending along at least a portion of the upper portion, a bottom surface, and two side portions extending between the upper portion and the bottom surface.

In some embodiments, the two upper surfaces are separated by a third surface.

In other embodiments, the pallet rail is a single piece of material that is folded along its length to create upper and lower surfaces and side portions.

In another aspect, a shipping pallet is disclosed that includes a deck having an upper surface, an opposing lower surface, and a length, at least two elongated rail engagement members extending downwardly from the opposing lower surface and running along at least a portion of the length of the deck, at least two pallet rails attached to the lower surface of the deck, each of the pallet rails having two upper surfaces extending the length of the rail to support the deck and a recessed portion to receive a respective one of the at least two elongated rail engagement members, the recessed portion having a plurality of projections extending into the recessed portion, wherein the plurality of projections of each of the at least two pallet rails engage at least two elongated rail engagement members so as to cause the pallet rails to be attached to said deck.

In another aspect, a method of manufacturing a shipping pallet is disclosed, the method includes a deck having an upper surface, an opposing lower surface, and a length, at least two elongated rail engagement members extending downwardly from the opposing lower surface and running along at least a portion of the length of the deck, and at least two pallet rails attached to the lower surface of the deck, each of the pallet rails having two upper surfaces extending the length of the rail to support the deck and a recessed portion to receive a respective one of the at least two elongated rail engagement members, the recessed portion having a plurality of projections extending into the recessed portion, wherein the plurality of projections of each of the at least two pallet rails engages at least two elongated rail engagement members so as to cause the pallet rails to be attached to said deck.

Additional features and advantages of the invention will be set forth in the detailed description which follows, and in part will be readily apparent to those skilled in the art from that description or recognized by practicing the invention as described herein, including the detailed description which follows, the claims, and the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
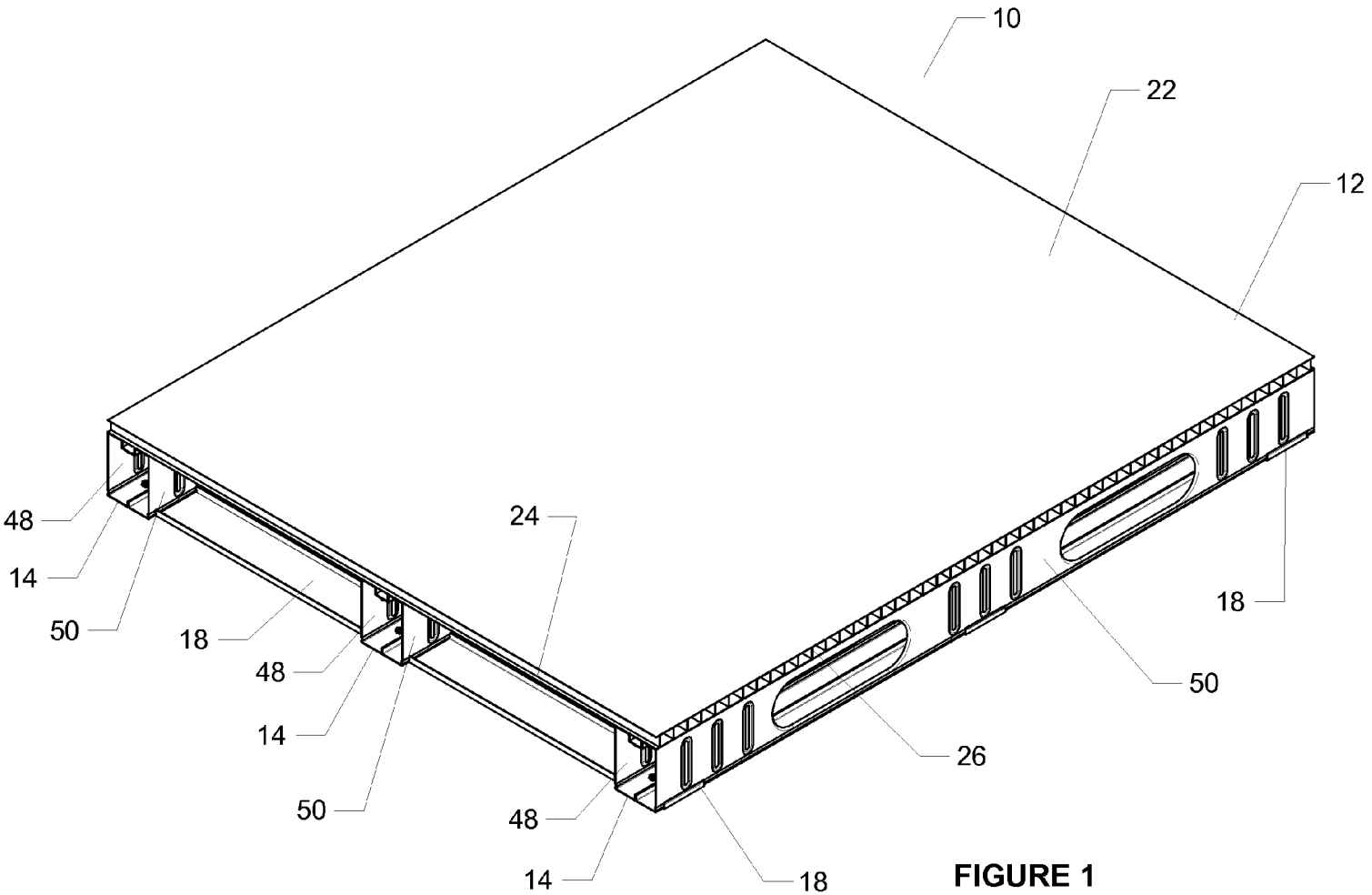
FIG. 1 is a top perspective view of a shipping pallet with the pallet rails according to one embodiment of the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
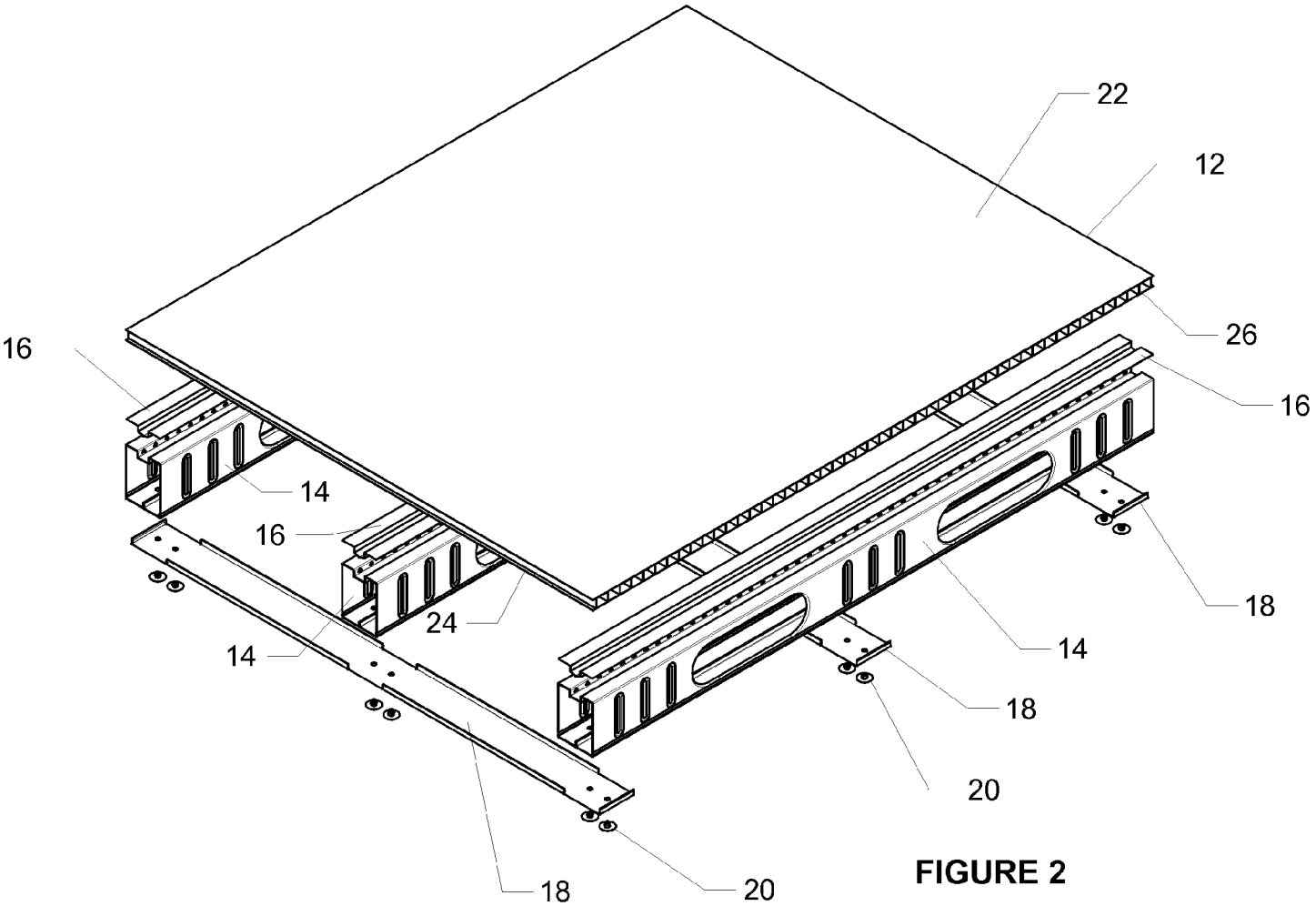
FIG. 2 is an exploded view of the shipping pallet and pallet rails according to the present invention.

Referring to FIGS. 1 and 2, a pallet assembly 10 according to one embodiment of the present invention is illustrated. The pallet assembly 10 preferably includes a deck 12 and three pallet rails 14, each of the pallet rails 14 preferably being the same. The pallet assembly 10 also preferably includes three elongated rail engagement members 16 attached to the deck 12 and engage and secure the pallet rails 14 to the deck 12. The pallet assembly 10 may also have more or fewer pallet rails 14 and elongated rail engagement members 16 than illustrated in FIG. 1 and still fall within the scope of the present invention. The pallet assembly 10 may also have connecting rails 18, three of which are illustrated in FIGS. 1 and 2. The connecting rails 18 are preferably connected to the pallet rails 14 by fasteners 20, which may be screws, rivets, plugs, etc.

The deck 12 preferably has an upper surface or skin 22, a lower skin or surface 24 and a central portion 26, which preferably has a corrugated, webbed, or honeycomb configuration. The deck 12 is preferably about 13 mm thick and is made from plastic, although any appropriate thickness and material may be used. The deck 12 is therefore weather and water resistant and is generally not subject to infestation by bugs or other detrimental creatures.

Figure 4:
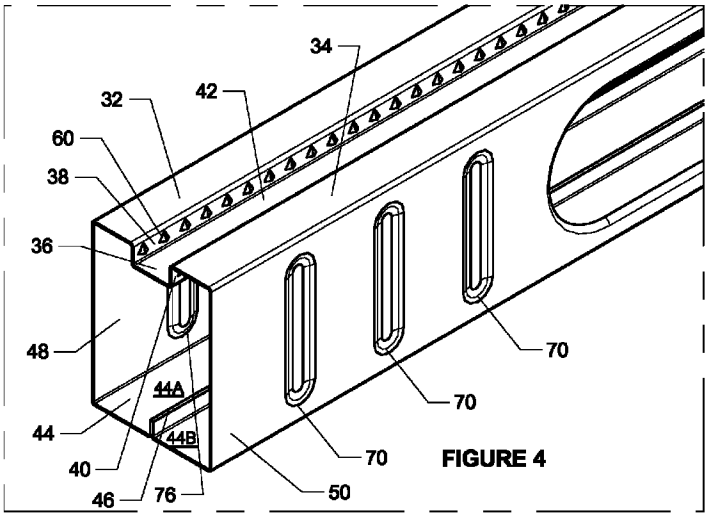
FIG. 4 is an enlarged perspective view of a portion of the pallet rail of FIG. 3 illustrating the projections.

The pallet rails 14 are preferably made of 18 gauge steel, although other thicknesses or similar materials of similar strength and abilities may be used. The pallet rails 14 are preferably 48" long, 3" wide, and 4" in height, but again may be of any relevant size and shape for use as pallet rails. The pallet rail 14 preferably has an upper portion 30, the upper portion 30 having two upper surfaces 32,34, which are also preferably separated by a lower surface 36. The lower surface 36 is connected to the two upper surfaces 32,34 by upward extending portions 38,40, creating a recessed portion 42. The two upper surfaces 32,34 are preferably in a first plane A, which is preferably parallel to and above the plane B in which the lower surface 36 lies, as best illustrated in FIG. 6. The pallet rail 14 also has a bottom surface 44, which as illustrated in FIGS. 4 and 6, that may be formed from two portions 44A and 44B, joined at seam 46. However, it is possible that the seam 46 be closer one corner or the other and not in the middle as illustrated in FIG. 6. Extending between the upper portion 30 and the bottom surface 44 are two side portions 48,50. As can be seen from FIGS. 4-6, the pallet rail 14 is preferably formed from a single piece of steel that is folded at least four times, but as illustrated in the figures, is folded ten times (including the two folds to create the portions 44A and 44B). Without the portions 44A and 44B, eight folds would be necessary to fold the pallet rail 14 as illustrated in the figures.

Figure 5:
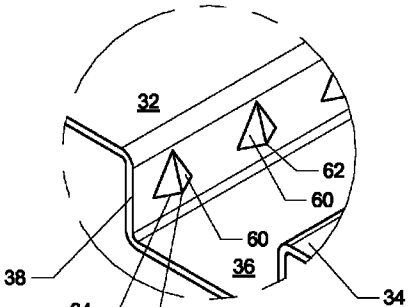
FIG. 5 is a detail view of the projections on the pallet rails of FIG. 1 according to one embodiment of the present invention.
Figure 7:
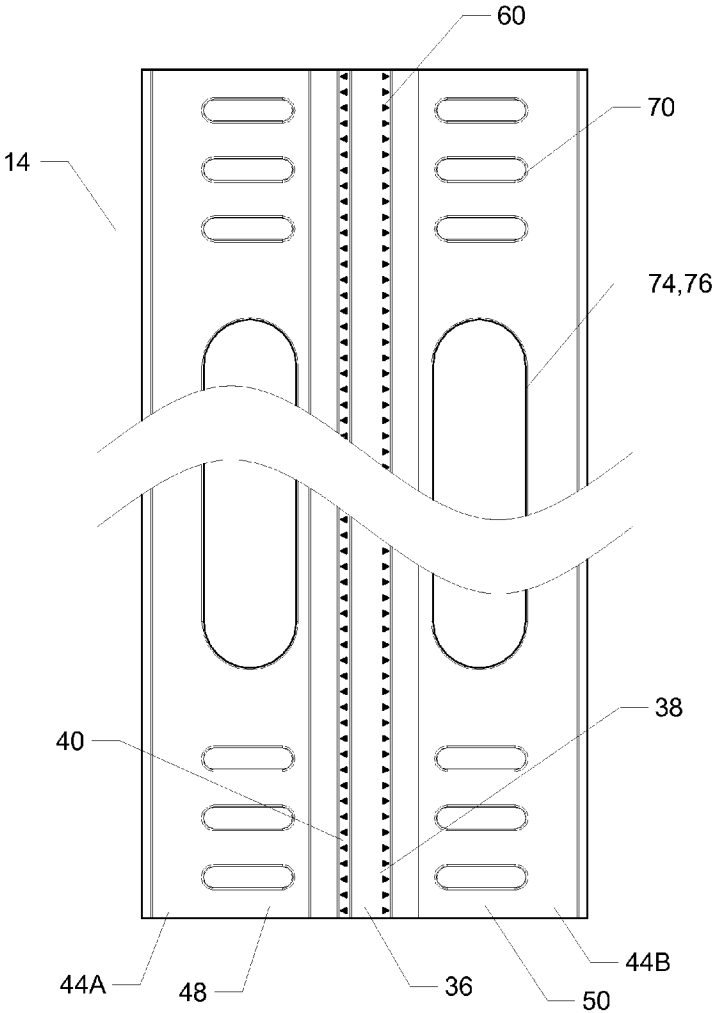
FIG. 7 is a perspective view of the pallet rail of FIG. 3 in a flat configuration prior to being folded.
Figure 6:
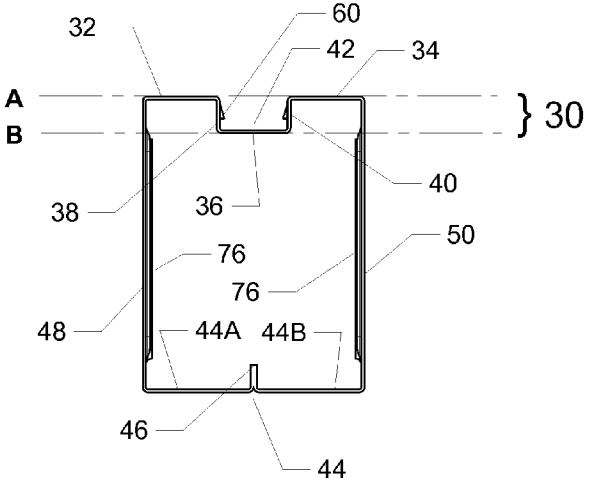
FIG. 6 is an end view of the pallet rail of FIG. 3.

As best illustrated in FIGS. 4 and 5, the upward extending portions 38,40 preferably have a plurality of projections 60 that extend into the recessed portion 42 that engage the deck 12, and more particularly the elongated rail engagement members 16 in the pallet assembly 10. The plurality of projections 60 are preferably die-punched when the pallet rail 14 is still a flat piece of metal and before it is folded as illustrated in FIG. 7. The size and shape of the projections 60 are preferably symmetrical as illustrated in FIG. 5. That is, the projections 60 each are triangularly shaped projections with a point 62 that will engage the sides of the elongated rail engagement members 16 as explained in more detail below. However, it is also within the scope of the present invention that the projections 60 have any other relevant shape. The size and shape of the projections 60 that are punched out are not particularly important. However, the projections 60 preferably have a lower surface 64 that engages and prevents the elongated rail engagement members 16 from moving upward and out of the recessed portion 42.

The two side portions 48,50 also have features that assist in the operation of the pallet rail 14. In particular, the features are included to provide strength to the pallet rail 14. First, there are embossed areas 70 to provide structural strength to the pallet rail 14. The embossed areas 70, of which there are preferably nine along each side portion 48,50, are also preferably stamped into the pallet rail 14 while it is flat and before it is folded. While nine embossed areas 70 are illustrated on each side portion 48,50, there may be more or fewer, and they may extend substantially the entire height of the pallet rail 14 or only a lesser height.

The two side portions 48,50 also preferably have openings 74, of which there are preferably two to accommodate the tines of a fork lift. The openings 74 preferably have an inwardly extending flange 76 (FIGS. 4 and 6) to provide structural strength to the opening 74 and the pallet rail 14.

Figure 3:
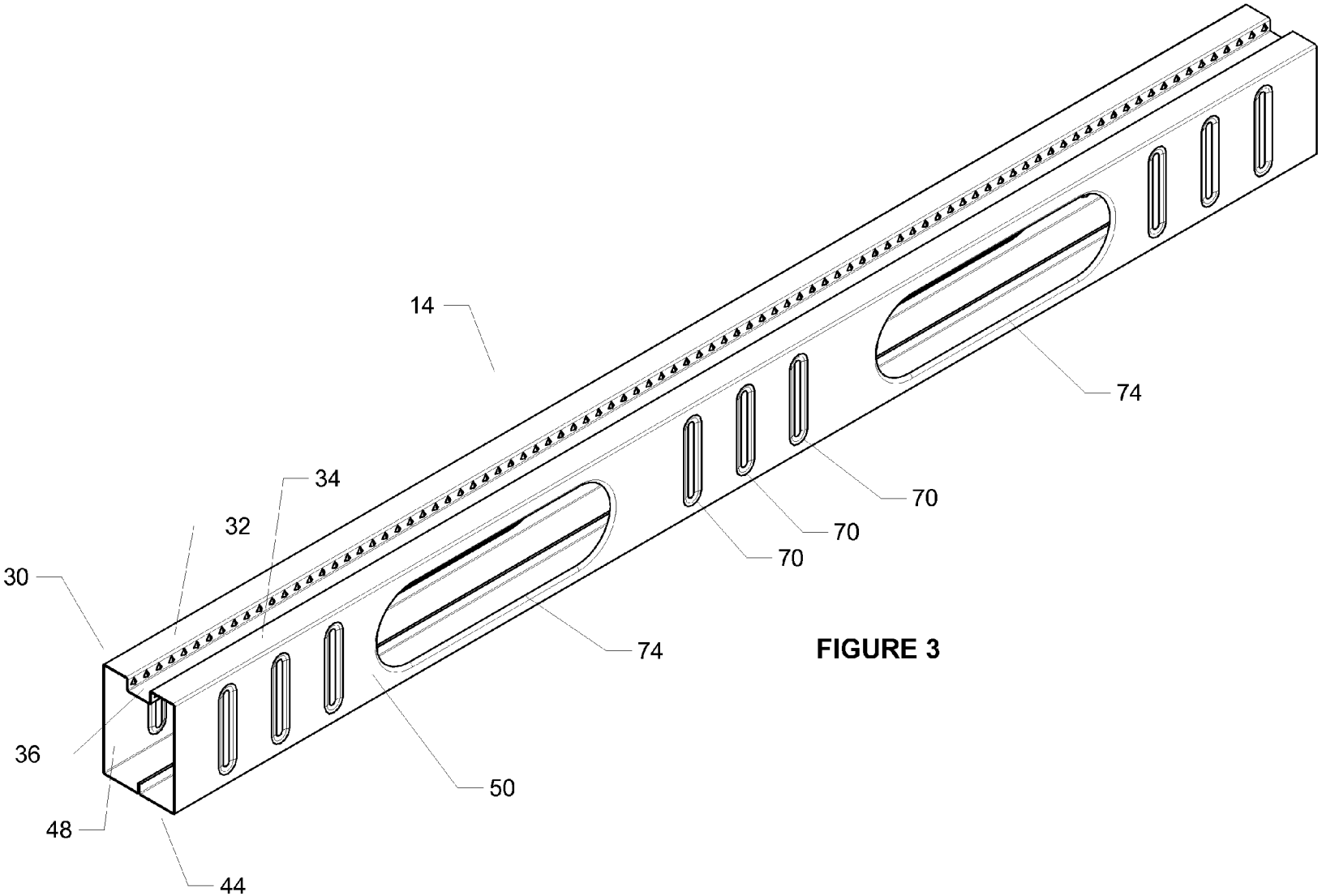
FIG. 3 is a perspective view of one of the pallet rails of FIG. 1 according to one embodiment of the present invention.

As illustrated in FIG. 7, a flat piece of steel (or other appropriate material, including, for example, aluminum, stainless steel, etc.) is punched or cut to make the projections 50 and the openings 74. The other structural elements, including embossed areas 70, may also be added while the pallet rail 14 is flat. This also includes the addition of the flanges 76 to the openings 74. The flat pallet rail 14 is then folded using appropriate dies so that, for example, when the flat pallet rail is folded to make the side portions 48,50 and the upward extending portions 38,40, the projections 60 extend from the upward extending portions 38,40 and into the recessed portion 42 as illustrated in FIG. 3. The seam 46 could be welded, spot welded, clamped, strapped, or tied to provide further strength, but is not required.

Figure 8:
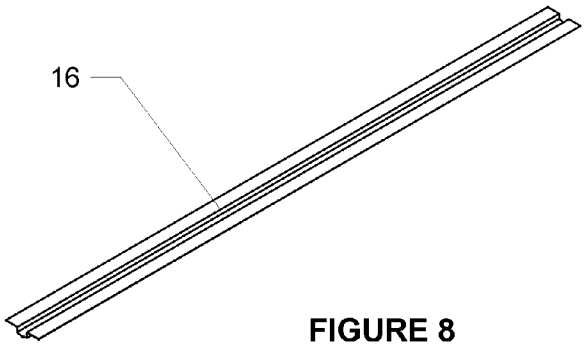
FIG. 8 is a perspective view of an elongated rail engagement member according to one embodiment of the present invention.
Figure 9:
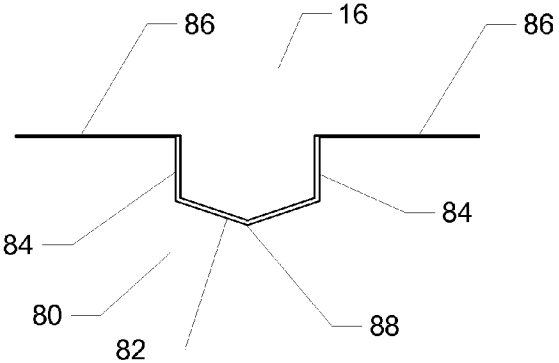
FIG. 9 is an end view of the elongated rail engagement member of FIG. 8.

An elongated rail engagement member 16 is illustrated in FIGS. 8 and 9. The elongated rail engagement member 16 is preferably made from plastic, but could be constructed of any appropriate material including, for example, rubber or foam and may also be solid rather than being shaped. As described in more detail below, it is preferable that the elongated rail engagement member 16 can deform. The elongated rail engagement member 16 preferably runs across the entire lower surface 24 of the deck 12, but could run along only a portion of the bottom surface 24 and still fall within the present invention. The elongated rail engagement member 16 has a center portion 80 that includes a bottom surface 82 and two vertical walls 84. The two vertical walls 84 attach to extension members 86. The elongated rail engagement member 16 engages the bottom surface 24 of the deck 12 by attaching the extension members 86 to the bottom surface 24. The extension members 86 can be secured by any method, including, for example, adhesives, fasteners, welding, ultrasonically welding, etc.

The bottom surface 82 preferably is configured with a point 88, causing the bottom surface 82 to slope downward from the two vertical walls 84. The elongated rail engagement member 16 is sized to fit within the recessed portion 42. As the bottom surface 82 engages the lower surface 36 of the upper portion 30, the configuration of the bottom surface 82 causes the two vertical walls 84 to flex outward thereby ensuring engagement of the two vertical walls 84 with the plurality of projections 60. The lower surface 64 of the plurality of projections 60 engage the two vertical walls 84, securing the rails 14 to the elongated rail engagement member 16 and deck 12.

Figure 10:
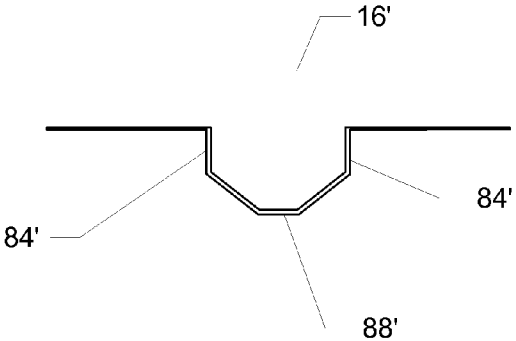
FIG. 10 is an end view of an alternative elongated rail engagement member according another embodiment of the present invention.

An alternative embodiment of elongated rail engagement member 16' is illustrated in FIG. 10. In this embodiment, elongated rail engagement member 16' is similar to elongated rail engagement member 16, but has a different configuration for the bottom surface 82'. Rather than having a point 88, the elongated rail engagement member 16' has a flat surface 88' that functions as the point 88 functions. That is, when the elongated rail engagement member 16' is inserted into the recessed portion 42 of the pallet rail 14, the contact of the flat surface 88' makes contact with the lower surface 36 of the upper portion 30, causing the two vertical walls 84' to flex outward.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A pallet rail to be used with a shipping pallet comprising:

an upper portion extending the length of the rail to support a shipping pallet deck, the upper portion having two upper surfaces and a lower surface, the lower surface connected to the two upper surfaces by upward extending portions, the lower surface and upward extending portions forming a recessed area between the two upper surfaces, the recessed area extending along at least a portion of the upper portion;

a bottom surface;

two side portions extending between the upper portion and the bottom surface; and at least one elongated rail engagement member comprising a bottom portion having a center point, said center point is pressed against the lower surface of the pallet rail causing two side portions of the elongated rail engagement member to be flexed outward to engage the projections.

2. The pallet rail according to claim 1, wherein the two upper surfaces lie in a first plane and the lower surface lies in a second plane, the first plane and the second plane being parallel to one another.

3. The pallet rail according to claim 1, wherein the pallet rail is a single piece of material folded along its length to create the upper surface, the lower surface and the two side portions.

4. The pallet rail according to claim 3, wherein the single piece of material is folded at least four times.

5. The pallet rail according to claim 1, wherein each of the plurality of projections are punched out of the upward extending portions.

6. The pallet rail according to claim 1, wherein each of the side portions has at least one opening therein to accommodate tines from a forklift.

7. The pallet rail according to claim 3, wherein the lower surface has a seam from the folding of the single piece of material, the seam being reinforced.

8. The pallet rail according to claim 1, wherein the at least one elongated rail engagement member has a flange connected to each of the two side portions, the two side portions connected by the bottom portion, the bottom portion generally oriented parallel to the flanges and sloping from the two side portions to the center point.

9. A shipping pallet comprising:

a deck having an upper surface, an opposing lower surface, and a length;

at least two elongated rail engagement members extending downwardly from the opposing lower surface and running along at least a portion of the length of the deck; and at least two pallet rails attached to the lower surface of the deck, each of the pallet rails having two upper surfaces extending the length of the rail to support the deck and a recessed portion to receive a respective one of the at least two elongated rail engagement members, the recessed portion having a plurality of projections extending into the recessed portion;

wherein the plurality of projections of each of the at least two pallet rails engages said at least two elongated rail engagement members so as to cause the pallet rails to be attached to said deck, wherein at least one of the two elongated rail engagement members comprises a bottom portion having a center point, said center point is pressed against a bottom surface of the pallet rail causing two side portions of the elongated rail engagement member to be flexed outward to engage the projections.

10. The shipping pallet according to claim 9, wherein the at least two elongated rail engagement members are integral with the deck.

11. The shipping pallet according to claim 9, wherein the at least two elongated rail engagement members are separate elements and are attached to the deck.

12. The shipping pallet according to claim 11, wherein the projections are heated to melt the deck adjacent the projections to increase bonding strength of the pallet rails to the deck.

13. The shipping pallet according to claim 9, wherein each of the at least two elongated rail engagement members has a flange connected to each of the two side portions, the two side portions connected by the bottom portion, the bottom portion generally oriented parallel to the flanges and sloping from the two side portions to the center point.

14. The shipping pallet according to claim 9, wherein an elongated member is inserted between the elongated rail engagement member and the pallet rail thereby deflecting a bottom portion of the elongated rail engagement member upward and causing the rail engagement member to be released from the pallet rail.

15. A method of manufacturing a shipping pallet comprising the steps of:

providing a deck having an upper surface, an opposing lower surface, and a length;

attaching at least two elongated rail engagement members to the opposing lower surface wherein the at least two elongated rail engagement members run along at least a portion of the length of the deck; and pressing the deck onto at least two pallet rails, each of the at least two pallet rails having two upper surfaces extending the length of the rail to support the deck and a recessed portion to receive a respective one of the at least two elongated rail engagement members, the recessed portion having a plurality of projections extending into the recessed portion;

wherein the plurality of projections of each of the at least two pallet rails engages said at least two elongated rail engagement members so as to cause the pallet rails to be attached to said deck, wherein the pressing of the deck onto the at least two pallet rails includes engaging a center point of the bottom portion of the at least two elongated rail engagement members on a bottom surface of the recessed portion to flex side portions of the at least two elongated rail engagement members outwardly to engage the plurality of projections.

16. The method according to claim 15, wherein the plurality of projections on the pallet rails are heated prior to pressing the deck onto the pallet rails.

* * * * *